United States Patent [19]

Ilmoniemi

[11] Patent Number: 4,731,163

[45] Date of Patent: Mar. 15, 1988

[54] PROFILE BAR IN A HEAD BOX OF PAPER MACHINE

[75] Inventor: Erkki Ilmoniemi, Vaajakoski, Finland

[73] Assignee: Valmet Oy, Finland

[21] Appl. No.: 13,449

[22] Filed: Feb. 11, 1987

[30] Foreign Application Priority Data

Dec. 13, 1986 [FI] Finland ..... 860669

[51] Int. Cl.[4] ..... D21F 1/06

[52] U.S. Cl. ..... 162/344; 162/347

[58] Field of Search ..... 162/344, 345, 346, 347, 162/336; 425/466

[56] References Cited

U.S. PATENT DOCUMENTS

| | | | |
|---|---|---|---|
| 1,240,589 | 9/1917 | Murray | 162/344 |
| 3,461,501 | 8/1969 | Stewart | 425/466 |
| 4,326,916 | 4/1982 | Flaig et al. | 162/344 |

FOREIGN PATENT DOCUMENTS

| | | | |
|---|---|---|---|
| 527129 | 6/1931 | Fed. Rep. of Germany | 162/344 |
| 182713 | 10/1984 | Japan | 425/466 |

*Primary Examiner*—S. Leon Bashore
*Assistant Examiner*—K. M. Hastings
*Attorney, Agent, or Firm*—Steinberg & Raskin

[57] ABSTRACT

A profile bar for a discharge opening of a head box of a paper machine, by means of which the profile of the discharge jet from the paper machine is controlled. The profile bar may be connected to adjustment spindles, by means of which the profile bar can be bent in a plane transverse to a direction of flow of the discharge jet. Bending stiffness of the profile bar in the direction of bending to be achieved by means of the adjustment spindles, is arranged to be substantially lower within areas facing the adjustment spindles than at a middle of an area between the adjustment spindles. Transverse sawings or recesses may be made into the profile bar with a spacing substantially denser than the spacing between the adjustment spindles or equivalent. Alternatively, the profile bar may be provided with projections to which the adjustment spindles are attached, with the height of the projections being greater than a maximum height of the profile bar in the space between the projections. Furthermore, the height of the profile bar between the projections may be at a minimum in the longitudinal direction thereof, in a proximity to the projections, and at a maximum at the middle of the area between the adjustment spindles.

8 Claims, 4 Drawing Figures

PROFILE BAR IN A HEAD BOX OF PAPER MACHINE

BACKGROUND OF THE INVENTION

The present invention is directed to a profile bar for a discharge opening in a head box of a paper machine, by means of which the profile of the discharge jet from the paper machine is controlled. The profile bar can be connected to adjustment spindles or to corresponding bending members, by means of which the profile bar can be bent in a plane transverse to a direction of flow of the discharge jet.

In a way known in the prior art, the discharge opening of the head box, through which the pulp suspension jet is discharged onto the forming wire or into the forming gap of the former, is fine-adjusted by means of a profile bar, to which several adjustment spindles are connected, situated side by side. By means of these adjustments spindles, the profile bar is bent so that the thickness profile of the discharge jet is suitable, as a rule as uniform as possible. In order for it to be possible to adjust the discharge opening, the profile bar must be movably supported on its top face, as a rule on the front wall of the upper lip beam of the head box.

In such supporting of the profile bar in the prior art, two different arrangements are used. In the first arrangement, several spring-loaded support pieces are used, which are placed to be uniformly situated over the length of the profile bar. In this arrangement, it is possible to use a low profile bar that is uniformly stiff in the direction of its length, in which case the cost of manufacture of the profile bar is low, and the profile bar operates in the desired manner within the areas between the adjustment spindles.

In the second prior art arrangement, a series of support pieces are used which are loaded by means of a pressurized loading hose. With respect to this solution, reference is made to U.S. Pat. No. 4,326,916, corresponding to Finnish Patent Application No. 803,316, to J. M. Voith GmbH. By means of this method, the frictional force opposed to the adjustment can be made uniform when viewed in the direction of the length of the profile bar.

Moreover, in Finnish Patent Application No. 853,750, filed Sept. 27, 1985, a third supporting arrangement for a profile bar is suggested. The supporting force is generated by means of a pressurized hose, however this supporting force is not transferred directly to the profile bar, as in the case of the second arrangement immediately described above. Rather, a rib-shaped support piece or a series of supporting pieces is/are used for the transfer of the supporting force, which act as twin-arm lever arms transmitting the supporting force, one arm part being loaded by a loading hose, while the other arm part of the lever arms is provided with a supporting face or supporting faces transmitting the supporting force of the loading hose directly or indirectly to the outer side of the profile bar.

The profile bar must have a certain mechanical strength and rigidity in the direction of bending. The prior art profile bars have involved the problem and drawback that the rigidity thereof in the direction of bending produced by means of adjustments spindles, is substantially constant. This is why detrimental deformations arise at the points on the profile bar at which the shape of the profile bar, which affects the profile of the discharge opening, cannot be corrected by means of the adjustment spindles.

It is partly due to this that, by means of the prior art adjustments spindles, it has not always been possible to adjust the profile of the discharge opening sufficiently accurately and steeply without the necessity of making the profile bar excessively flexible, in which case the bar is insufficiently strong in other respects, or its handling, e.g., in connection with installation thereof, becomes difficult.

In some prior-art profile bars, projection parts have been used in the upper portions thereof which are provided with attaching brackets for being attached to the adjustment spindles. Such projection parts have resulted in the fact that the profile bar becomes stiffer than average in the direction of bending of the profile bar at the zones of the adjustment spindles. In other words, with the objectives and concepts of the present invention in mind, the stiffest portions of the profile bars are located exactly in the wrong locations.

SUMMARY OF THE INVENTION

Accordingly, it is an object of the present invention to provide a profile bar for a head box in which the above-discussed drawbacks can be substantially avoided.

This and other objects are obtained by the present invention which is principally characterized by bending stiffness of the profile bar in a direction of bending to be achieved by means of adjustment spindles or equivalent, is arranged to be substantially lower within the area facing the adjustment spindles than at the middle of an area between the adjustment spindles.

In the profile bar according to the present invention, the stiffness thereof in the direction of bending by adjustment spindles or equivalent, varies so that the stiffness is at a minimum at the adjustment spindles, and at a maximum at the middle of the area between the spindles. In this manner, it is possible to eliminate generation of detrimental deformations at such points at which the form of profile bar affecting the profile of the discharge opening, cannot be corrected by means of the adjustment spindles.

It can be established by means of strength calculations, that in a profile bar in accordance with the present invention, the maximum permitted bending degree is not reduced to a significant extent, while the necessary spindle force is not considerably increased.

The variation in thickness of the profile bar in accordance with the present invention in the direction of the length of the profile bar, and expressly in the direction of bending is produced, e.g., in the position of operation of the profile bar, by means of vertical and transverse sawings or notchings, or alternatively, by means of wave-shaped or stepwise form of the upper edge of the profile bar.

BRIEF DESCRIPTION OF THE DRAWINGS

The present invention will be described in greater detail below with reference to certain exemplifying embodiments of the present invention illustrated in the accompanying drawings, to which the present invention is not intended to be exclusively confined. In the drawings.

DESCRIPTION OF THE PREFERRED EMBODIMENTS

Figure 2:
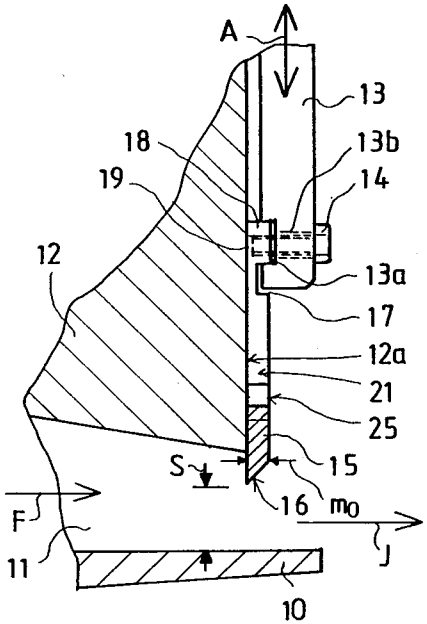
FIG. 2 is a sectional view along a line II—II in FIG. 1.

The discharge part of a head box of a paper machine illustrated in FIG. 1–4, comprises a lower lip beam 10 and an upper lip beam 12. A discharge duct 11 is defined between the lower lip beam 10 and bottom wall of the upper lip beam 12, the duct 11 becoming narrower in the direction of flow F of the pulp suspension. The pulp suspension flow is discharged as a discharge jet J onto a forming wire (not illustrated) running over a breast roll of the paper machine.

A profile bar 15 in accordance with the present invention is attached to to a front wall 12*a* of the upper lip beam 12 by means of a supporting arrangement known in the prior art. By means of adjustment (arrow A) of adjustment spindles 13 attached to the profile bar 15, it is possible to precisely control profile of the height S of the discharge opening, the purpose being, as a rule, to provide as uniform a discharge jet J as possible.

The profile bar 15 is pressed away from its support face 12*a* by pressure of the pulp suspension flow F, for which reason the profile bar 15 must be supported from its outer side within a sufficiently wide area. The supporting of the profile bar is not illustrated in greater detail in the accompanying figures, with such details of supporting arrangements, for example, being found in U.S. Pat. No. 4,326,916 (corresponding to Finnish Application No. 803,316, to J. M. Voith GmbH) and to Finnish Patent Application No. 853,750. The profile bar in accordance with the present invention is not confined to any particular supporting arrangement. In any event, it should already be ascertained in this connection that a sufficiently wide contact area remains in the profile bar of the present invention, e.g., for the loading hose of the supporting arrangement.

At the bottom edge of the profile bar illustrated in FIGS. 1–4, there is a chamfering 16 in a manner known per se, the lower edge of the chamfering 16 defining the top edge of the discharge opening 11. The upper part of the profile bar 15 is provided with a groove 17, above which there is a projection part 18. The projection part 18 has chamfered plane faces, which fit onto corresponding chamfered faces of the groove 13*a* in the adjustment spindle 13, so that by threading a screw 14 into the threaded hole 19 in the projection part 18, a play-free attachment between the profile bar 15 and the adjustment spindles 13 is produced between the projection 18 and the groove 13*a*, the details of such attachment being described more closely in Finnish Patent Application No. 854,013, filed Oct. 15, 1985.

Figure 1:
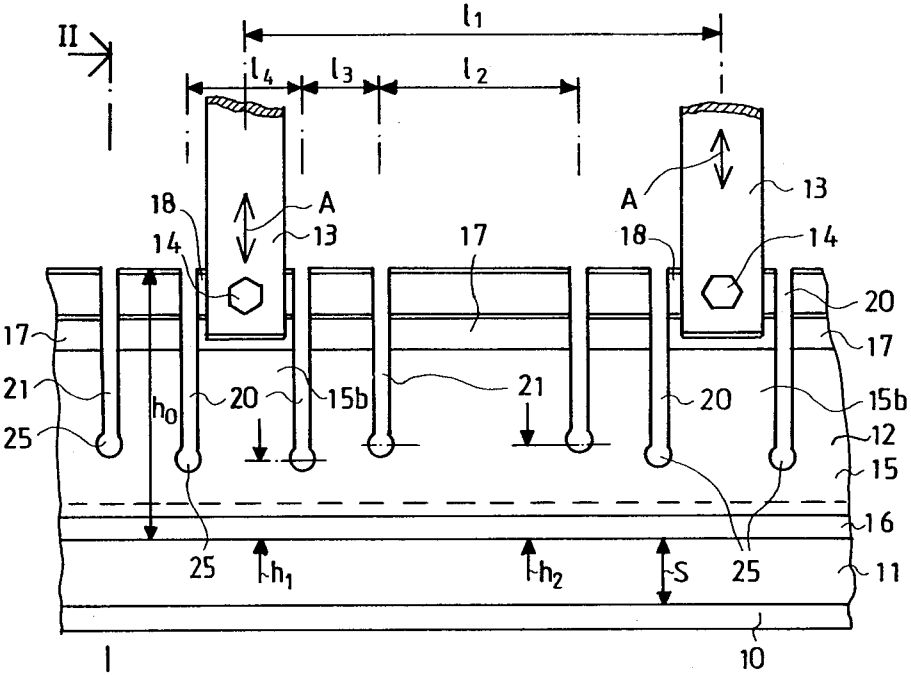
FIG. 1 is a front elevational view of a first exemplifying embodiment of a profile bar in accordance with the present invention, with the profile bar in its operating position.

In accordance with FIGS. 1 and 2, transverse sawings or recesses 20 and 21 opening at the top edge of the profile bar, have been made into the profile bar 15. The sawings or recesses situated nearest to the adjustment spindles 13, are more densely spaced $l_3$ and $l_4$ than the sawings or recesses situated towards the middle of the area $l_1$ between the adjustment spindles 13, as illustrated. Moreover, the sawings or recesses 20 situated nearest to the adjustment spindles, are deeper than the sawings or recesses situated towards the middle of the area $l_1$ between the adjustment spindles 13 ($h_2 > h_1$). Roundings 25 are produced at the bottom ends of the sawings or recesses 20 and 21, e.g., by means of drilling. These rounded bottoms 25 have a diameter larger than the width of the sawings or recesses, as illustrated in FIG. 1.

Figure 4:
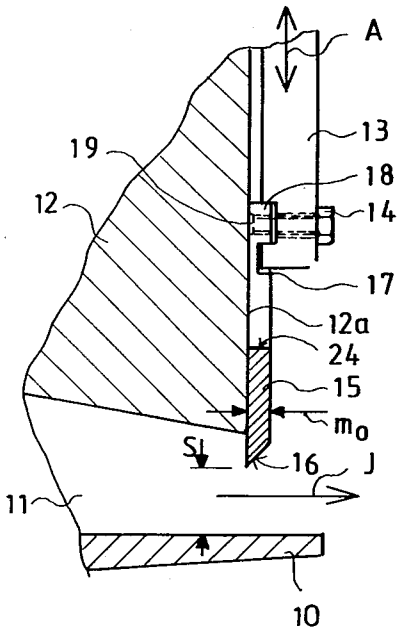
FIG. 4 is a sectional view along line IV—IV in FIG. 3.
Figure 3:
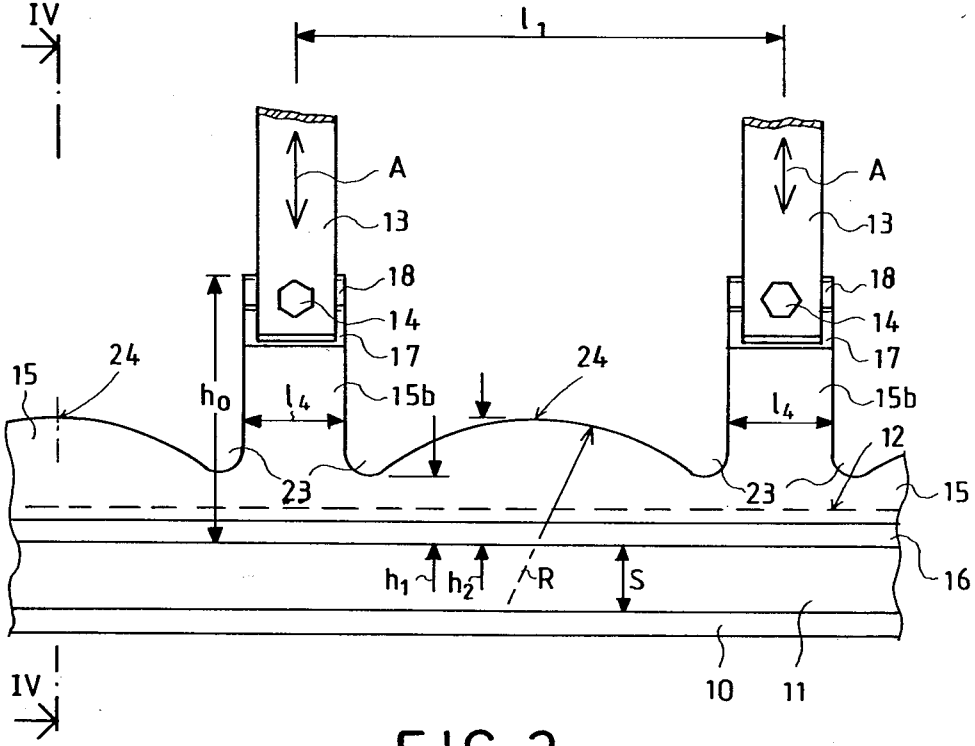
FIG. 3 is a front elevational view similar to FIG. 1 of a second variation in accordance with the present invention.

According to FIGS. 3 and 4, the profile bar 15 is provided with projection parts 15*b* of uniform width, facing the adjustment spindles 13, the projection parts 15*b* corresponding to the part 15*b* between the deepest sawings 20 in FIGS. 1 and 2. The adjustment spindles 13 are attached to these projections 15*b*. Between the projection parts 15*b*, there are wide recesses 23 with rounded bottoms, defined by the projection parts 15*b*. Between these recesses 23, i.e. in the middle area of the space $l_1$ between the adjustment spindles 13, the height h of the profile bar is increased, being at a maximum $h_2$ at point 24 which is located at the middle of the space $l_1$ between the projection parts 15*b* and the recesses 23.

The top edge of the profile bar 15, is, e.g., shaped substantially as a circular or elliptical arc, whose radius of curvature is denoted by R. The height $h_0$ of the projection 15*b* is substantially greater than the maximum height $h_2$ of the space between the projections 15*b*, while the height of the profile bar 15 between the projection parts 15*b*is a mininum $h_1$ in the longitudinal direction thereof, at the proximity of the projection bars 15*b*. More particularly, the projection parts 15*b* have a substantially uniform width $l_4$. The recesses 23 situated at both sides of the projection parts 15*b* as illustrated, are symmetrically wide with rounded bottoms. The minimum height $h_1$ is situated facing the bottom of the recesses 23 as illustrated, with the maximum height $h_2$ of the profile bar 15 between the projection 15*b*, i.e. at point 24, preferably being about twice the minimum height $h_1$ of the profile bar 15.

An example of dimensioning of the profile bar 15 of FIGS. 1 and 2 is given as follows:

$h_0$=40 to 50 mm;

$m_0$=4 to 6 mm;

$h_1$=20 to 40 mm;

$h_2$=25 to 50 mm;

$h_2-h_1$=3 to 15 mm;

$l_1$=100 to 150 mm;

$l_2$=(1.2 to 2.0)×$l_3$;

$l_3$=10 to 20 mm;

$l_4 \geqq l_3$.

There may also be a greater number of sawings or recesses 20, 21 within the distance $l_1$ between the spindles 13, than what is illustrated in FIGS. 1 and 2, in which case the dimension $l_3$ accordingly has lower values than above.

In the profile bar illustrated in FIGS. 3 and 4, i.e. in the "waved" version of the profile bar 15 with no sawings, the dimensions $h_1$, $h_2$ and $l_1$, $l_4$ are of the same order of magnitude as in the dimensioning example for FIGS. 1 and 2 given above.

In the matter described above, a profile bar 15 is provided with stiffness in the direction of the effect of the bending by the adjustment spindles 13, varying so that the stiffnes is at a minimum at the adjustment spindles 13 and at a maximum in the middle area of the space $l_1$ between the adjustment spindles 13. Thus, it is now possible to increase the flexibility of the profile bar 15 at the portions where flexibility is required most, so that increasingly larger and steeper deformations acting upon the profile of the discharge opening can be produced in the profile bar 15 without risk of damage.

The profile bar 15 in accordance with the present invention is, as rule, made from steel, preferably acid-proof stainless steel. However, wear-resistant plastics may also be used.

The service life of a profile bar 15 is about 1 to 2 years with the wear thereof resulting principally from fillers present in the pulp suspension flow F, in particular from clay.

The preceding description of the present invention is merely exemplary, and is not intended to limit the scope thereof in any way, so that details of the invention may vary within the scope of the inventive concept thereof, from the details described above.

What is claimed is:

1. Profile bar for a discharge opening in combination with a head box in a paper machine, by means of which the profile of a discharge jet of the paper machine is controlled, the profile bar being connected to a plurality of adjustment spindles or corresponding bending members by means of which the profile bar can be bent in a plane transverse to direction of flow of the discharge jet, wherein said profile bar is structured so that bending stiffness of said profile bar in a direction of bending to be achieved by means of said adjustment spindles or corresponding bending members, is substantially lower at the adjustment spindles or bending members than at the middle between adjacent adjustment spindles or bending members.

2. The bar of claim 1, additionally comprising transverse sawings or recesses made into said profile bar with a spacing substantially denser than a spacing between the adjustment spindles or equivalent.

3. The bar of claim 2, wherein said sawings or recesses are more closely spaced in the proximity of the adjustment spindles than in the middle of the area between the adjustment spindles.

4. The bar of claim 3, wherein said sawings or recesses in the proximity of the adjustment spindles are substantially deeper than sawings or recesses placed at or near the middle of the area between the adjustment spindles.

5. The bar of claim 2, wherein said sawings or recesses each have a rounded bottom of diameter greater than a width

6. The bar of claim 1, additionally comprising projections situated upon said bar, and attached to the spindles or bending members, said profile bar having a height at said projections substantially greater than a maximum height thereof between said projections, the maximum height between said projections of said profile bar being substantially at the middle of an arc between the adjustment spindles, and said profile bar having a minimum height in a longitudinal direction thereof in a proximity of said projections.

7. The bar of claim 6, additionally comprising symmetrically wide recesses with rounded bottoms on both sides of said projections, said projections having a substantially uniform width, and a curved portion between said recesses having the maximum height at the middle of the area between the adjustment spindles.

8. The bar of claim 7, wherein said curved portion between said recesses has substantially the shape of a circular or elliptical arc, the maximum height of said profile bar between said projections is about twice the minimum height of the profile bar between said projections, and the minimum height of said profile bar is situated at the rounded bottoms of said recesses.

* * * * *